United States Patent [19]

Miotti

[11] Patent Number: 5,056,242

[45] Date of Patent: Oct. 15, 1991

[54] UNDERGROUND WALL CONSTRUCTION METHOD AND APPARATUS

[75] Inventor: Giouse Miotti, Lugano, Switzerland

[73] Assignee: Finic, B. V., Rotterdam, Netherlands

[21] Appl. No.: 350,993

[22] Filed: May 12, 1989

[51] Int. Cl.[5] ..... E02F 5/08; E02D 5/18

[52] U.S. Cl. ..... 37/94; 37/91; 37/195; 405/267; 405/287

[58] Field of Search ..... 37/80 R, 83, 86, 87, 37/91, 94, 195; 405/267, 286, 287

[56] References Cited

U.S. PATENT DOCUMENTS

| | | | |
|---|---|---|---|
| 2,048,710 | 7/1936 | Ranney . | |
| 3,139,729 | 7/1964 | Miotti . | |
| 3,564,855 | 2/1971 | Morner . | |
| 3,603,099 | 9/1971 | Zakiewicz . | |
| 3,614,161 | 10/1971 | Miotti . | |
| 3,645,101 | 2/1972 | Sherard | 405/267 |
| 4,084,648 | 4/1978 | Yahiro et al. | 405/267 X |
| 4,379,658 | 4/1983 | Schmednecht | 405/267 |
| 4,824,176 | 4/1989 | Barre . | |
| 4,834,197 | 5/1989 | Bauer et al. . | |
| 4,844,549 | 7/1989 | Steff de Verninac . | |
| 4,861,199 | 8/1989 | Hackmack | 405/267 |
| 4,882,859 | 11/1989 | Bollinger . | |
| 4,883,134 | 11/1989 | Bollinger et al. . | |
| 4,909,674 | 3/1990 | Kenno et al. | 405/267 |
| 4,934,978 | 6/1990 | Arzberger et al. . | |

*Primary Examiner*—Dennis L. Taylor
*Assistant Examiner*—J. Russell McBee
*Attorney, Agent, or Firm*—Jim Zegeer

[57] ABSTRACT

Apparatus and method for constructing an impervious underground wall in which an initial excavation, filled with an excavating slurry, is made having a length $L_1$. A milling excavator is lowered to the bottom of the initial excavation in a collapsed condition and then expanded outwardly by a linkage mechanism in the direction of the trench portion, transmitting a reaction or bearing force to a wall of the initial excavation to excavate from the bottom upwardly. The cuttings fall to the bottom of the trench and are removed by suction or an air lift. The initial excavation is thus expanded laterally from the bottom up with the excavation forces from the excavation being transmitted to the opposing wall surface. Precast concrete panels having convave sides, one concave and one convex end, are inserted into the excavation and have formations on the end to interlock with one another and serve as an excavating guide for the excavating tool. Plastic concrete fills the spaces between the excavation walls and the concave side faces of the precast elements. The apparatus includes a milling drum having a horizontal axis and mounted on an extendable linkage which, in turn, is carried by a main frame. The apparatus is lowered by cable to the bottom of the trench and one or more hydraulic rams are actuated to extend the milling drum which the rock mill is rotated by a preferably hydraulic drive motor. The main frame is guided by the precast panel and at the same time, the reaction forces from the excavation are horizontally transmitted to the adjacent previousy formed panel section.

8 Claims, 6 Drawing Sheets

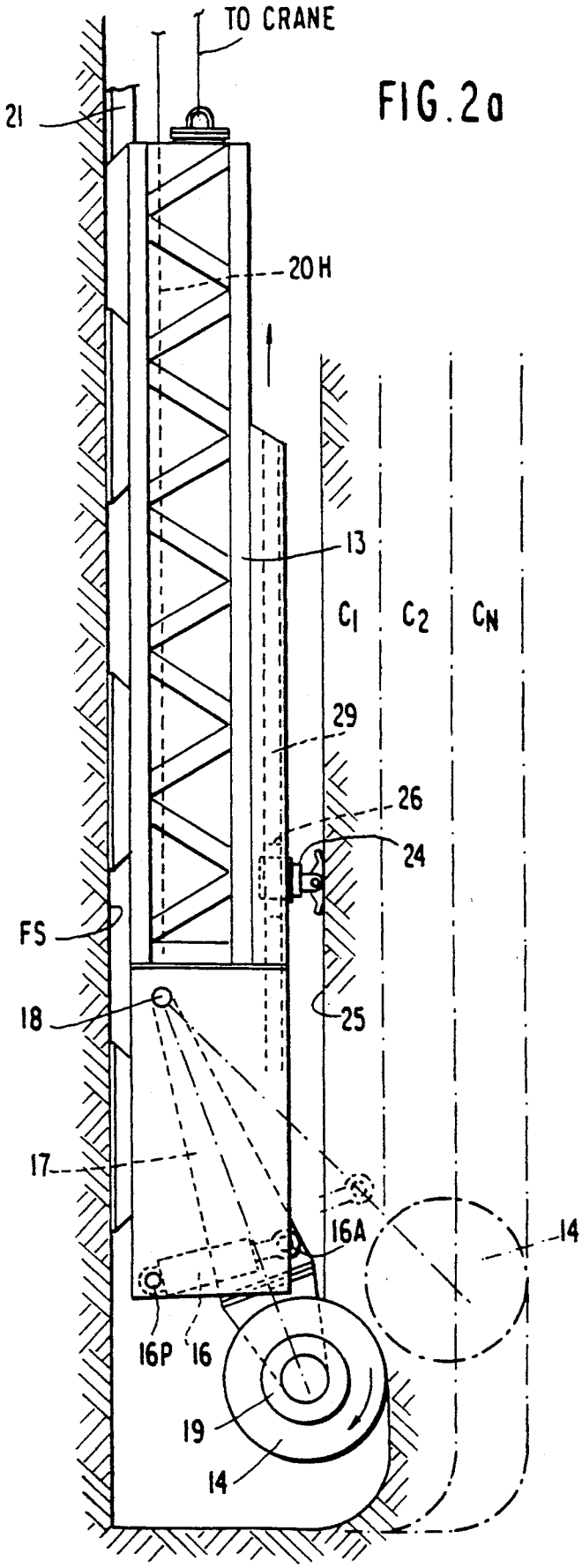
FIG. 2a
FIG. 2b
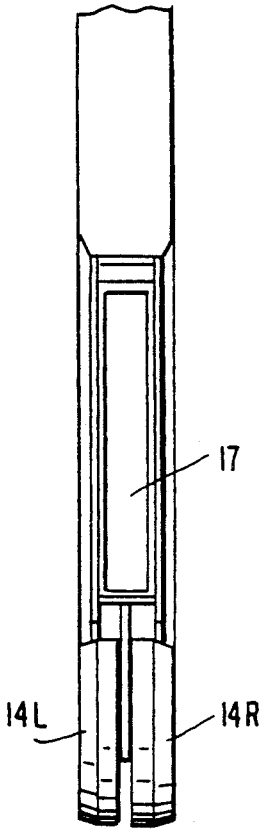

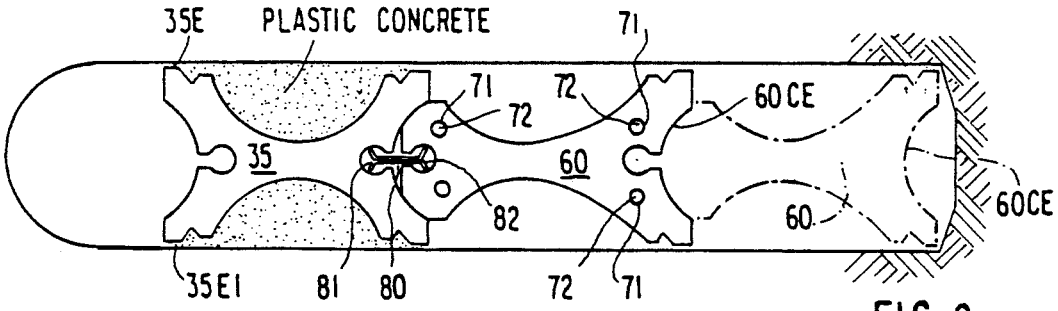
FIG. 9
FIG. 10
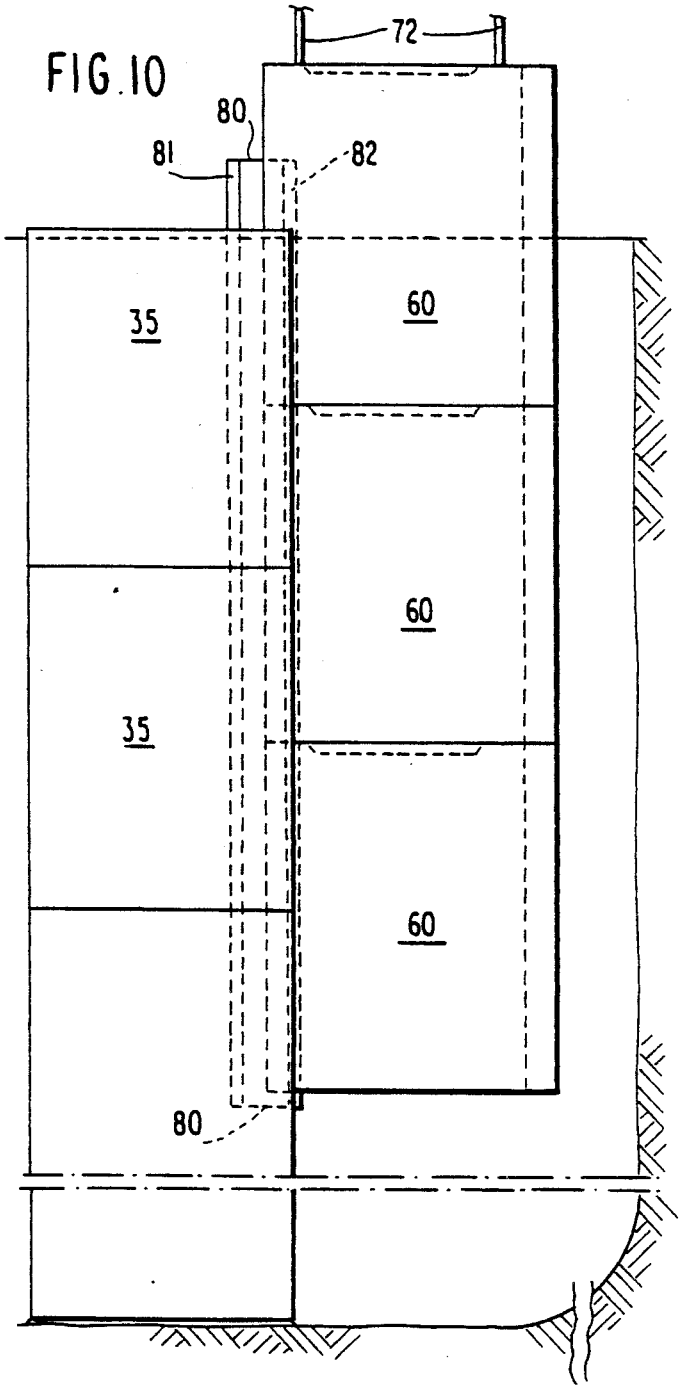
FIG. 7
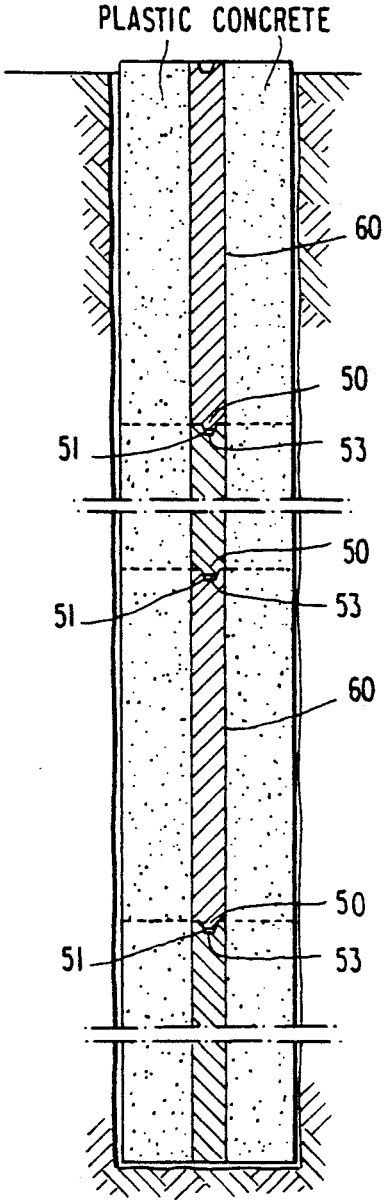

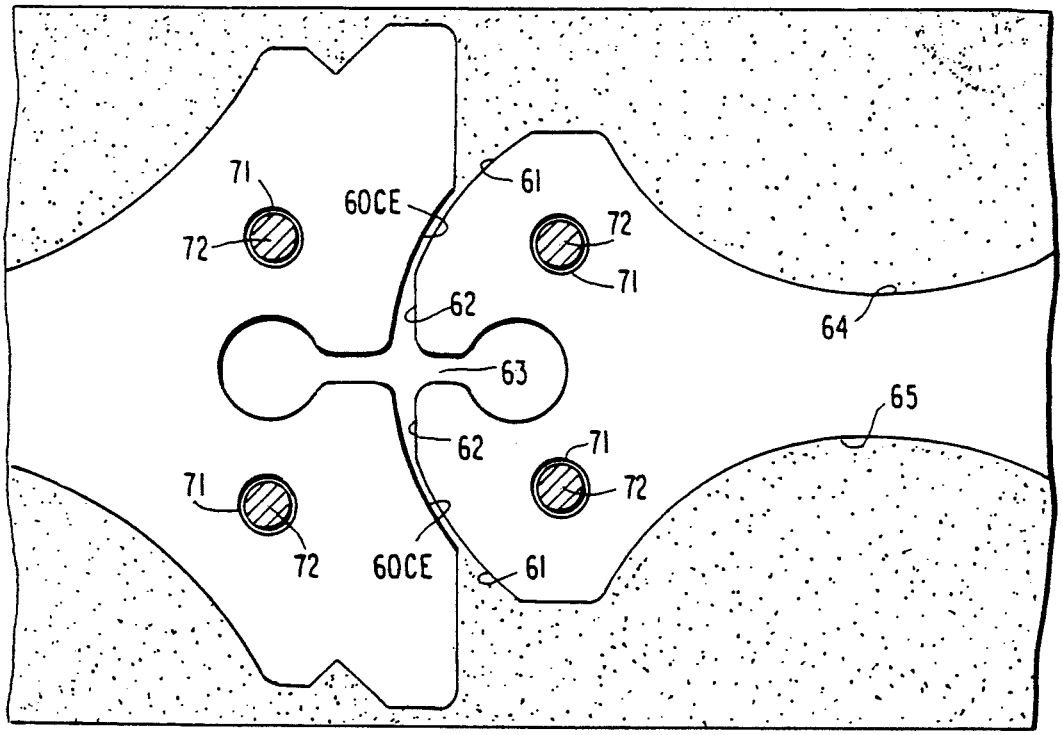
FIG. 11
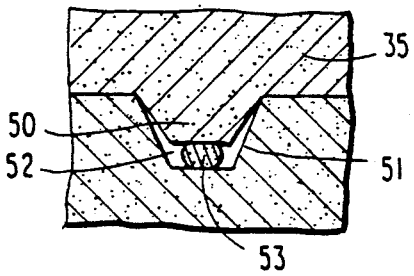
FIG. 8
FIG. 12
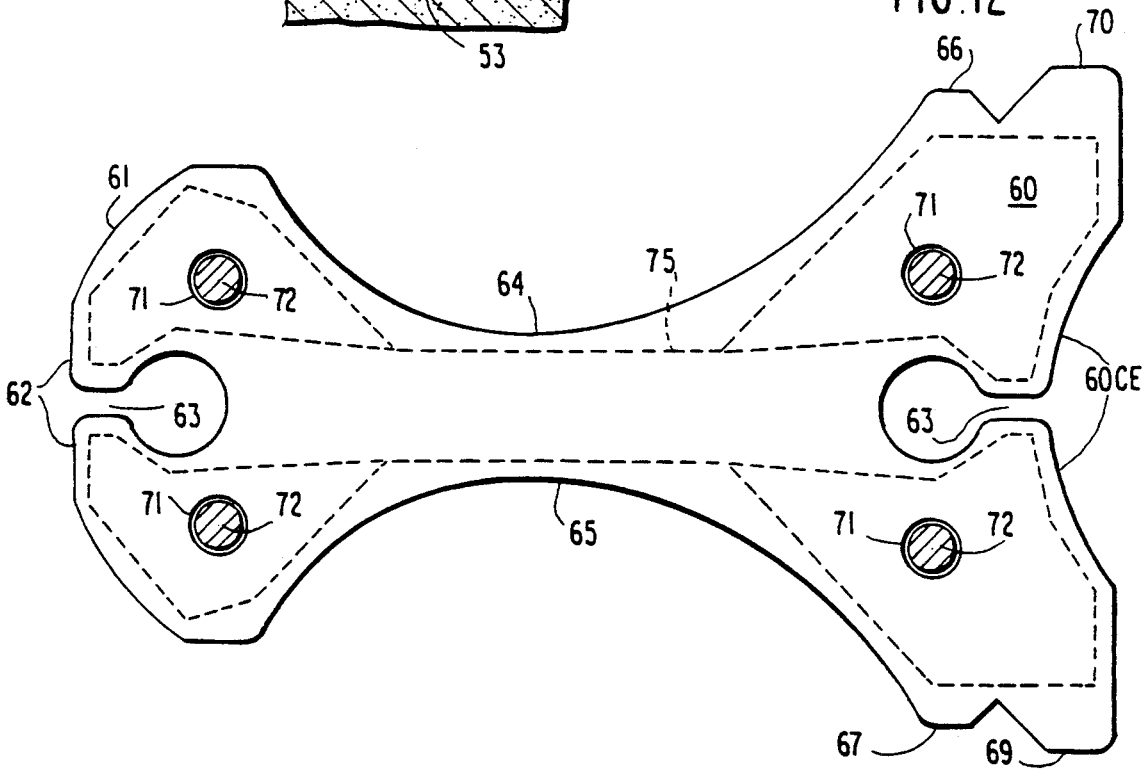

UNDERGROUND WALL CONSTRUCTION METHOD AND APPARATUS

BACKGROUND AND BRIEF DESCRIPTION OF THE INVENTION

In the past, rock "slicers" and machines for "cutting" a rock with pressure tools, with the ability to transduce and a monitor to display screen the performance and position of the cutting blades were known in the art. The concept of a traveling rotary tool is disclosed in my U.S. Pat. No. 3,614,161 in which the tool discharges reactions caused by the action of excavation almost exclusively in the transverse direction to the main axis through a guide and against one or other lateral walls of the excavation. In Sherard, U.S. Pat. No. 3,645,301, the various forms of downwardly operating rock excavating tools are disclosed in conjunction with a movable rigid barrier for separating the initial slurry-filled starter hole or trench so that fluid columns of the slurry are formed on the front and rear sides of the barrier. In each of these techniques, the trench is maintained full of an excavating slurry, typically a mixture of bentonite, clay or mud. In each case, the excavation is from an upward direction downwardly upon the soil or earth or rock to be excavated. These prior art excavation systems use reverse circulations as well as air lifts for removing the excavated material from the trench.

According to the present invention, a rock mill is provided for removing rock by vertical increments from the bottom of the trench upwardly while operating from a full depth "starter" hole and can be withdrawn from the excavation quite easily. This allows the excavated material to fall away from the cutting edge thereby improving the production rate and disassociating the excavation rate from the removal of the spoils. It also utilizes previously poured panel or, in the preferred embodiment, a precast panel which has been lowered into the excavation to discharge part or all of the reaction it needs to apply pressure to the cutting tool so that the resulting equipment can be made lighter and simpler and more maneuverable. Moreover, by using as a starter hole the joint of a previously poured or installed concrete panel, the invention can guarantee full section, continuity of the wall joint and not just the minimum contact (typically about 18").

Moreover, the invention avoids a critical draw back of all tools which remove rock in a downward mode namely, the removal of spoils. For a cutting tool to be efficient all chips of rock have to be immediately removed from the point of advancement of the cutting teeth of the tool otherwise they will be reground by the cutting teeth while imposing a continuous risk of wedging the cutting wheel. This is generally accomplished by direct or reverse air fluid circulation. For the circulation to be efficient the quantity and pressure of air or fluid has to be substantial which results in high cost and potential stability dangers. In a preferred embodiment of this invention, a conventional air lift at the bottom of the starter hole is utilized.

Furthermore, rock penetration is a function of the weight on the cutting teeth and of the stability of the machine. The preferred embodiment of the invention utilizes in part the horizontal reaction of a previously poured concrete section or the precast section which has been lowered into the trench to apply pressure on the tool and remains firmly positioned against the cutting surface being guided by the joint.

Thus, a significant feature of the method aspects of the invention is in the idea and concept of excavating a trench slot in rock from the bottom up rather than from the top down. It is easier and less expensive to drill a large shaft from the bottom up rather than in a downward mode.

Another advantage of a preferred embodiment of the invention is that a hydraulically operated expandable or extendable milling wheel permits an excavation by undercutting of existing structures which may be a very significant advantage in the work on a main dam under an outlet structure, for example. Moreover, this method allows for easy contact between the slurry wall and any existing concrete surface even in inclined ones since it can easily regulate the amount of penetration of the cutting tool into the concrete.

Where the overburden is conventional soils, excavation will proceed through the embankment and core materials with traditional slurry wall clam shells, backhoe and excavation in rock will start where the excavation by clam shells end.

In the initial excavation, which can as noted above, be by means of conventional clam shells or by backhoe, the excavated trench is filled with a lean bentonite-slurry mix thus eliminating the need of excavating with a rock milling machine at or near the surface and giving the possibility of a better guide to the tools on the surface. Starter panels are utilized which allow the start of the chain of excavation in both directions. Once the excavation of the starting slot is completed, the bottom is cleaned and the bentonite slurry is desanded and an amount of cement-bentonite is placed at the bottom of the trench. When the trench is ready, a series of quadraconcave starter precast concrete elements, which may be steel reinforced, stacked one on top of the other, are lowered into the trench in such a way as to leave a width of unobstructed, grout-filled trench at each side of the stacked precast elements. The stacked precast elements are automatically aligned with respect to each other by a tongue-and-groove system at each horizontal interface. The horizontal seal between the individual precast elements is guaranteed by a sealant such as a bentonite sausage sandwiched between the upper and lower elements spanning from one vertical groove to the other. This bentonite sausage is manually placed in the groove of the panels while installing them.

These precast elements are placed for the entire depth of the excavation. Both the upstream and downstream concave bases are simultaneously filled with plastic tremie concrete which will displace the grout and permanently stabilize and integrate the precast elements with the earth fill embankment and the rock. The unique shape and construction of the precast elements is such that they will create a guide from which to continue the trenching operations while minimizing the possibility of concrete flowing into the adjacent chambers or trench sections.

When the starter panel is in place, a single axle rock or swaying mill cleans the grout and the guide trench until the bottom of the excavation is reached. Cuttings are excavated by slurry circulation. After the cleaning operation is completed, the single axis rock mill continues the excavation exploiting as many capabilities in upward, horizontal or downward direction. This operation is effectively guided by the sides of the previously cut trench as well as by the precast element already in place thus insuring continuity and consistency with the vertical alignment of the precast concrete elements already in place. The excavation of the cuttings will depend on the direction of the excavation of the cutting mill and will either be continuously excavated by a slurry circulation, air left at the bottom or will be taken out once the trenching is completed by a mechanical clam shell. When the trenching and the cleaning of the bottom is completed, the guiding opening of the previously cast concrete elements is cleared of grout by a correspondingly shaped tool and the bentonite in the trench is now lifted from the bottom by an air lift and is circulated through the desander until the qunatity of sand in suspension is brought within a predetermined percentage (2%, for example). This operation always sweeps the bottom of the excavation clean and is routinely performed unless the system used to excavate the cuttings was such as to warrant a clean bottom of the excavation and a maximum percentage of sand content within the limits previously set.

When the excavation is ready a predetermined volume of cement bentonite grout is pumped to the bottom of the excavation and as soon as the grout is placed, a series of precast concrete panels stacked one on top of the other is lowered into the excavation. This column of stack of precast elements have convex ends which interengage and fit within the concave ends and have opposite concave ends similar to those in the starter precast concrete elements. The concave sides of those elements make them light-weight and their shape maks them easy to use. This vertical chain of precast panels is horizontally aligned by a tongue-and-groove system in the precast panels while its vertical alignment is insured by a temporary continuous guide placed into the opening existing in the previously cast element. This temporary continuous guide is lowered at the same rate of the precast panel to the bottom of the excavation thus interlocking the previously placed precast panels to the elements being placed. As noted above, squeezed into the tongue-and-groove recesses is a bentonite sausage which insures the water tightness of this connection. As the stack of precast elements reaches the bottom, the suspending rods and the temporary continuous guides are withdrawn and a plastic tremie concrete is then preferably simultaneously placed into the upstream and downstream concave spaces thus stabilizing and integrating the precast elements with the earth fill embankment in the rock. The process is sequentially repeated to achieve a chain of stacked precast elements to form the wall and panel sections.

This new technology automatically insures:

1) Full continuity of the trenching since each excavation is the guided extension of the previous one;

2) It allows direct visual inspection of the quality, soundness and dimensional fitness of each precast panel thus guaranteeing the same quality throughout the wall;

3) The plastic concrete placed upstream and downstream of the precast elements although of high quality, does not determine the water tightness of the wall which is entrusted to the bentonite sausage for the horizontal joints, the cement grout for the vertical joints and the precast panels themselves for the majority of the surfaces and the concrete in the concave spaces;

4) Virtually all of the elements determining the water tightness of the wall are visually inspected while being installed and the vertical joints are individually checked hydrostatically before being sealed with grout;

5) Unique working features of the single axle rock or swaying mill that allows to excavate in a upward, and horizontal direction and downward as well, and enables it to be easily withdrawn from the excavation. Moreover, the rockmill with proper teeth orientation can be rotated in either direction.

BRIEF DESCRIPTION OF THE DRAWINGS

The above and other objects, advantages and features of the invention will become more apparent when considered with the following specification and accompanying drawings wherein:

FIG. 2*a* is a side elevational view of the rock mill, FIG. 2*b* is a side view thereof, FIG. 7 is a sectional view through trench holes showing the jointing between stacked elements, FIG. 8 is an enlarged view showing the section joined between two precast elements and the sealant (a bentonite sausage), FIG. 9 is a top plan view showing the interrelationship between a precast starter element and a precast element which is being placed, FIG. 10 shows the lowering of a column of the precast elements into the trench, FIG. 11 is an enlarged detail of the vertical interlocking connection between a two precast elements, and FIG. 12 is a sectional view showing of a precast element showing the preferred configuration thereof.

DETAILED DESCRIPTION OF THE INVENTION

Figure 5:
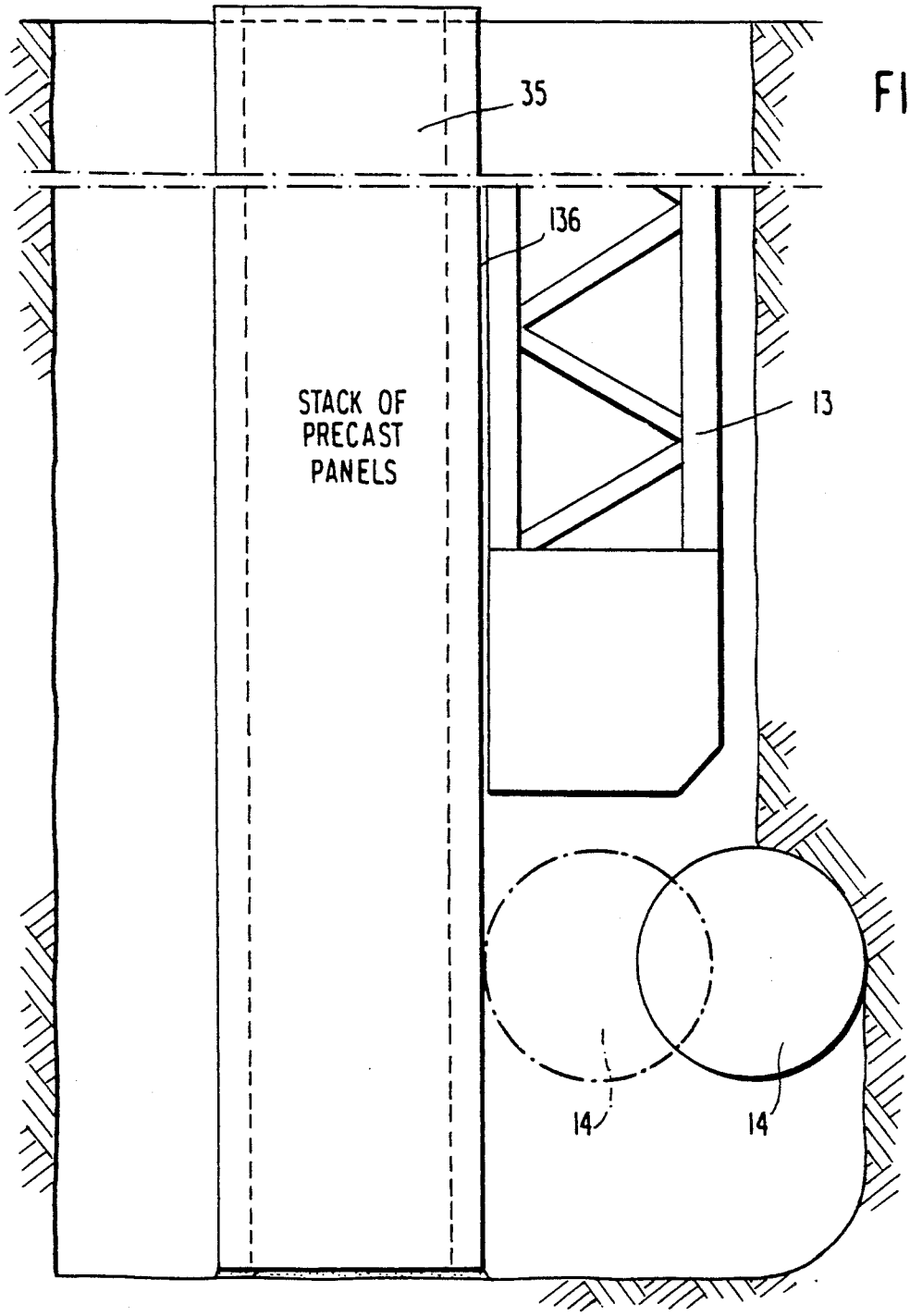
FIG. 5 is shows the rock mill which has been lowered into the portion of the enlarged starter hole that is not occupied by the column of precast elements.

Referring now to FIGS. 1 and 2, an initial excavation of the earth or overburden 10 is performed by typical clam shells, backhoe or the like, with the trench being maintained open by a bentonite slurry mix 11 and an initial or starter bore hole 12 is excavated down to the desired depth of the wall. A steel frame 13 carrying a hydraulically operated rock mill 14 is lowered with the rock mill 14 closed or retracted so that it is lowered to the bottom of the trench or initial hole 12. As indicated in FIG. 5, the rock mill 14 is preferably stowable under the frame 13 during lowering into the hole. Then the rock mill 14 is extended by a hydraulic ram 16 which swings the mounting arm 17 of rock mill 14 about an arc having as its pivotal center pivot 18. The rock mill 14 is hydraulically driven by a hydraulic motor 19 supplied from hydraulic control and monitoring system 20 via hydraulic lines 20H, and the mill is comprised of a pair of a spaced rock mill wheels 14-1, 14-2. Note in particular that the reaction forces generated by the ram or hydraulic motor 16 forcing the rock mill 14 into the bottom of the column of rock to be excavated is transmitted via the two pivot pins 18 and 16P via the frame 13 to the facing surfaces FS of the initial bore hole 12. A suction or air lift pipe 21 is utilized to remove the cuttings.

The milling wheels 14L and 14R (FIG. 2*b*) are illustrated as rotating in a clockwise direction which is the preferred direction since the cuttings then are dropped directly to the bottom of the trench where they may be lifted by an air lift or by suction lift. However, it is clearly within the ambit of the invention that the rock mill wheels 14L and 14R rotate in a counter-clockwise direction so that the cuttings then travel over the wheel and into the suction lift by line 21. It will be appreciated that the teeth (not shown) will be oriented according to the selected direction of rotation and angle of attack on the rock. In addition, after the rock mill is removed, the final bottom clean up of that panel section can be achieved by air lift or by a suction lift.

As shown in FIG. 2*a*, a guide member 22 with outstretched legs 23 is projected by a hydraulic element 24 against the unexcavated face 25. The base 26 of the spacer member moves in a track way 29 on frame 13 as the rock mill is moved upward for deep trenches and walls, when the guide member reaches the end of track 29, it may be withdrawn from engagement and raised to the end of track 29 and then reengaged with the unexcavated section.

Figure 1A:
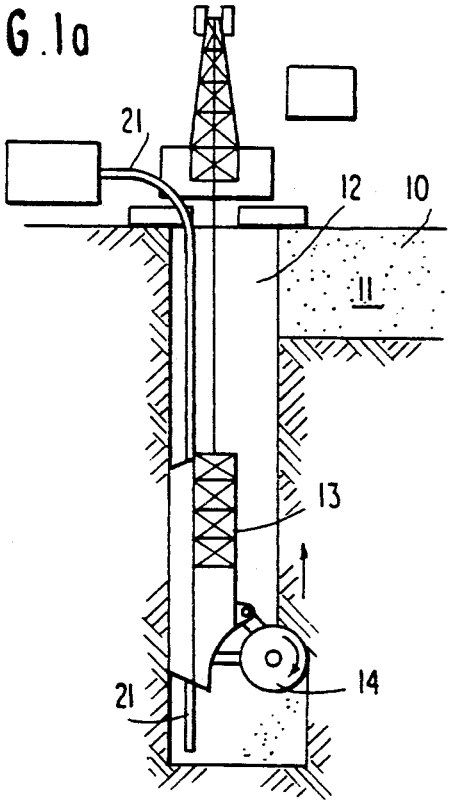
FIG. 1*a* is a diagrammatic side, elevational view showing the positioning of a rock mill according to the invention in the bottom of a starter hole and the raising of the rock mill to excavate from the bottom up.
Figure 1B:
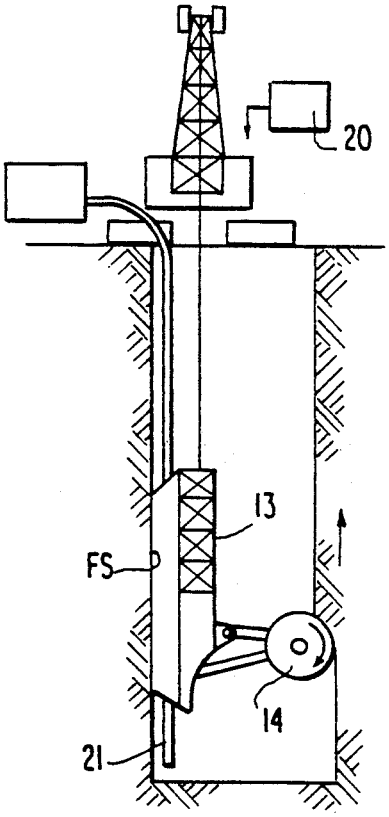
FIG. 1*b* is a diagrammatic side elevational view showing the further excavation with the rock mill fully extended and excavating from the bottom upwardly of the initial bore hole or starter hole.
Figure 1C:
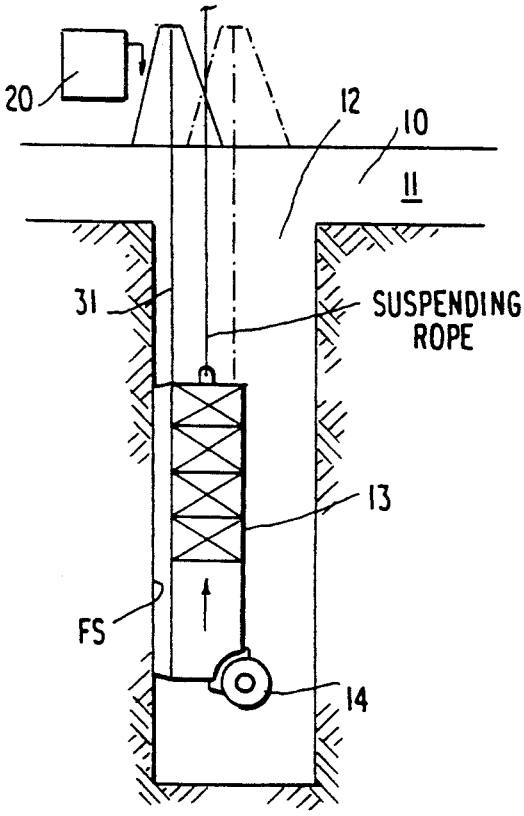
FIG. 1*c* illustrates the use of line to control vertically.

As shown in FIG. 1*c*, a cable or suspending line suspends the frame 13 from a crane or other rig 30 which moves along the line of the wall. A line 31 to control the verticality is conventional and may be used, if desired.

Figure 1D:
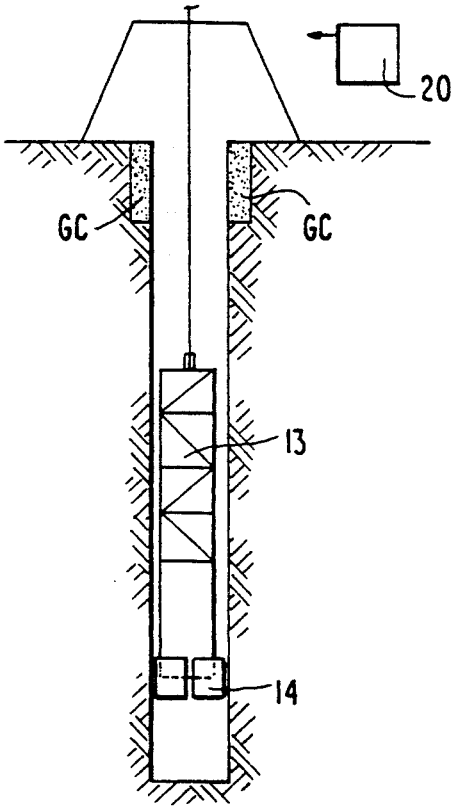
FIG. 1*d* is an end view.

As also shown in FIG. 1*d*, horizontal guide curbs may be cast along the line of the wall at the surface so as to accurately define the width of the wall and the line of the wall, and assist in performing the excavations. Such guide walls are shown in Brunner British Patents 913,527 and 913,528.

Figure 3:
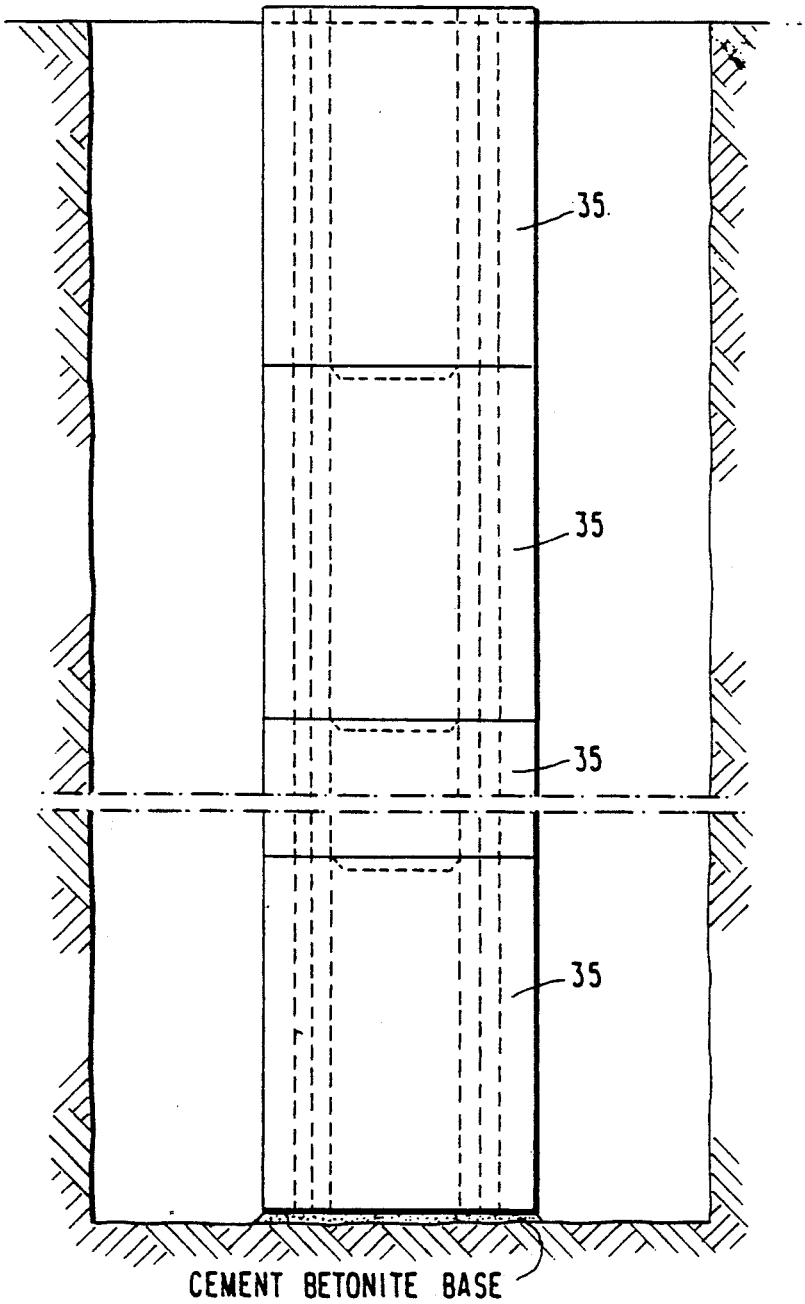
FIG. 3 shows the series of precast starter elements that have been stacked and lowered into the initial starter hole.
Figure 4:
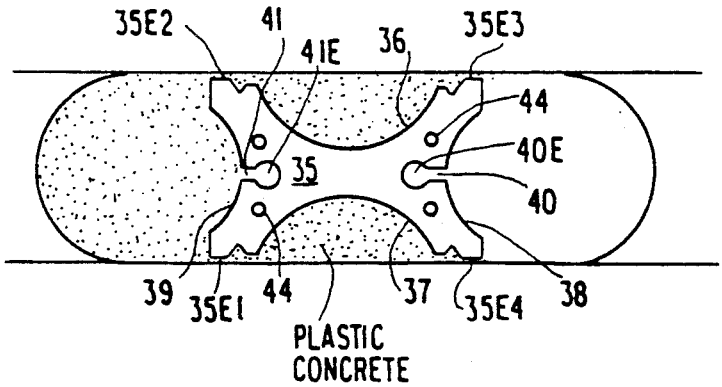
FIG. 4 is a top plan view of FIG. 3 and illustrates the unique quandra-concave configuration of the precast starter elements.

Referring now to FIGS. 3 and 4, after the initial bore hole has been enlarged by the action of the rock milling tool a precast starter element shown in sectional view of FIG. 4 and in FIG. 3 where a number of them are stacked and lowered into the starter hole. In this embodiment, the bottom of the trench has been cleaned by a suction lift or other means of bottom cleaning and a cement grout has been placed in the bottom of the trench so that when the bottom element is seated on it, it fits and seals the bottom of the trench. The precast starter 35 elements are stacked one upon the other and have the configuration shown in plan view wherein the two end sections are concave and the two side sections are likewise concave. Note that in these precast starter elements the ends $35E_1$, $35E_2$, $35E_3$ and $35E_4$ form a barrier to the plastic concrete which has been tremied into the spaces formed by the concavity of the sides of the precast starter elements 35. The elements 35 may be steel reinforced and have interengaging or locking tongue-and-groove formations on their contiguous upper and lower edges, respectively and an expandable sealant such as a bentonite sausage (see FIGS. 7 and 8) incorporated herein.

As shown in FIG. 4, each of the precast starter elements 35 has concave sides 36, 37, and concave ends 38, 39. This starter element is adapted to permit the excavation and wall forming process to be extended in both directions (e.g. left and right in FIG. 4) simultaneously. As indicated, these precast starter elements 355 are provided with concave ends 38 and 39 which have guide slots 40, 41 formed therein for receiving a temporary continuous guide 50 (see FIG. 9). The guide slots are provided with an enlarged portion 40E, 41E for receiving flanges 81, 82 of temporary continuous guide 71 (FIG. 9). Openings 44 are aligned in the stacked elements and constitute alignment and suspension holes for the suspending bars which lower the stacked elements into the starter hole. After these elements are lowered into the starter hole, a plastic concrete is placed to seal the concave sections 36, 37 and secure the elements 35 in place to the walls of the excavation.

Figure 6:
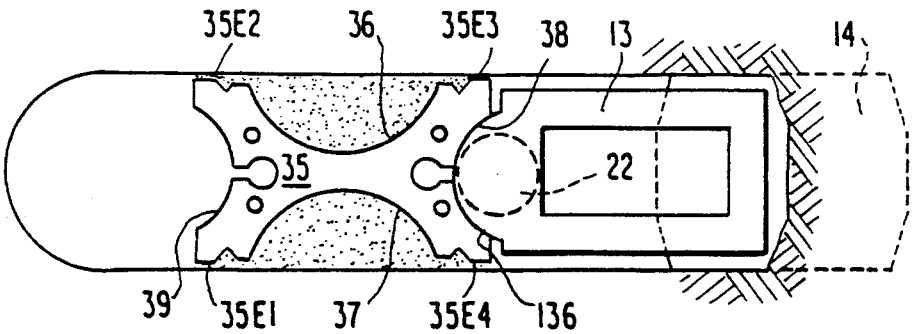
FIG. 6 is a top plan view of the arrangement shown in FIG. 5.

The rock milling tool 14 and its frame 13 are guided into the excavation again, this time utilizing the concave end 38 or the concave end 39 and lowered to the bottom of the hole left therefor because the size of the starter elements 35 leave sufficient space in the first formed hole such that the frame 13 and the rock mill can easily be lowered to the bottom of the trench. As shown in FIG. 6, the end 13G of the frame 13 is adapted to fit in the concave surface 38 to guide the tool.

Hydraulic motor or ram 16 is operated to project the rock mill 14 against the face of the unexcavated column of rock gradually extended to the depth of cut desired and then the frame is gradually raised while the rotary rock mill 14 chisels and cuts away the successive columns $C_1$, $C_2 \ldots C_n$ of rock from the bottom up. The machine travels upwardly as it rotates so that all excavated material falls on the bottom where it is removed by an air lift. The hydraulic implementation extends outwardly the rock milling wheels as much as is necessary to create an excavation wide enough to place an additional precast element plank while again leaving enough space to reinsert the milling machine in its closed position. The work continues sequentially and ultimately the precast panels are grouted in place to establish the perfect contact and load distribution with the adjacent soils.

As shown, each column of earth or rock is excavated preferably from the bottom up in a rapid and expeditious manner with the debris or spoil and cuttings falls to the bottom or, as indicated earlier, being partially removed by a suction end or air lift. The spacer or guide element 22 and 27 is extended for each cut and provides some stability for the frame 13 but the main stability of the frame comes from the reaction between the frame 13 against the concave face 38, 39 of the precast element and the rock mill itself.

The precast elements have a horizontal joint which is generally shown in section in FIG. 8. As shown in FIG. 8, a tongue 50 is formed on the lower edges of each precast element and a groove 51 is formed in the upper edge of each precast element. Note that the groove 51 is deeper than the extent of tongue 50 to leave a space 52 in which is placed a sealant in the form of bentonite sausage 53 which, upon taking up moisture, swells and expands to provide a permanent seal for each joint between each precast element. It is not necessary that the elements have the same vertical height. In fact, the heights of the lower-most ones may be varied so as to avoid a straight or horizontal joint between successive columns of stacked precast elements.

After the second panel section has been excavated, the precast elements having the unique and advantageous configuration shown in FIG. 12 are utilized. As shown in FIG. 12, these elements 60 have one concave end 60LE corresponding to the concave ends of the precast starter elements 35 and one generally convex end 61 which has a pair of straight portions 62 spanning a continuous groove 63. The continuous grooves 63 have an enlarged end to receive the flanges 81, 82 on the temporary continuous guides 50, which also serve as high pressure clean out holes. Concave sidewalls 64, 65 lead up to a larger end 66, 67 and a seal surface 69, 70, surfaces 69 and 70 being the closest or in engagement with the sidewalls so as to provide a seal when plastic concrete or grouting is placed in the concave section 64, 65.

Openings 71 are for suspending bars 72 (FIG. 10). A temporary continuous guide 80 having flared or flanged ends 81, 82 fits or slides into enlargements 83, 84 in the precast starter element 35 and the precast elements 60 (shown in detail in FIG. 12). Each of the precast elements has its own individual reinforcing cage 75 shown in outline in dotted line in FIG. 12.

As shown in FIG. 10, a series of precast panel elements 70 is being lowered into the trench on suspension cables or suspension bars 72. A cement-bentonite grout again may be placed on the bottom of the panel section so as to provide a solid seal and seating for the lower most of the precast panel elements 70 being lowered and placed into the trench. The continuous temporary guide 80 is removed after the elements have been lowered into the trench. A plastic concrete is then placed into each side in the space formed by the concave surfaces 64, 65 filling all of the spaces with the end enlargements 69, 70 serving as stops to prevent the plastic concrete from extending into the next section. The next section is maintained full of bentonite slurry so as to maintain and sustain the walls during the next excavation. The enlargement and guide slots for the temporary continous guides 80 are cleaned using high pressure cleaning and then the joint spaces are filled with the cement grout from the bottom up. By observing the level of the liquid once the cleaning is done, the water tightness of these joints is automatically tested. Thus, the final wall is constructed of a series of quadra-concave precast concrete elements stacked one on top of the other which have been lowered into the trench in such a way as to leave a width of unobstructed grout-filled trench at each side of the stacked precast elements.

The stacked precast elements are automatically aligned with respect to each other by the tongue and groove system at each horizontal interface and the horizontal seal between the elements is guaranteed by a bentonite sausage sandwiched between the upper and lower elements spanning from one vertical groove to the other. The bentonite sausage is manually placed into the grooves of the panels while installing them. The precast elements are placed for the entire depth of the excavation. Both the upstream and downstream concave spaces are simultaneously filled with plastic tremie concrete which displaces the grout and will permanently stabilize and integrate the precast elements with the earth fill enbankment and the rock. The shape of the precast elements in such that they create a guide from which to continue the trenching operations while minimizing the possibility of concrete from flowing into the adjacent chamber excavations.

When the starter panel is in place, the single axle rock or swaying mill 14 cleans the grout and reams the guide trench until the bottom of the excavation is reached and cuttings are excavated by slurry circulation. As the cleaning operation is completed, the single axis mill will continue the excavation exploiting its milling capabilities in an upward, horizontal or downward direction and this operation is effectively guided by the sides of the previously cut trench wall as well as by the precast element already in place thus insuring continuity and consistency with the vertical alignment of the precast concrete elements already in place. The excavation of the cutting will depend on the direction of the excavation of the mill 14 and will either be continuously excavated by slurry excavation or will be taken out once the trenching is completed by mechanical clam shell. When the trenching and the cleaning of the bottom is completed, the guiding opening of the slots of previously cast elements is cleared of grout by a complementary shaped tool, and the bentonite in the trench is now lifted from the bottom by an air lift which is circulated through a desander until the quantity of sand in suspension is brought within a certain percentage (2%). This operation also sweeps the bottom of the excavation clean and is routinely performed unless the system used to excavate the cutting was such as to warrant a clean bottom of the excavation and a maximum percentage of sand content within the limits previously set.

When the excavation is ready, a predetermined volume of cement bentonite is pumped or tremied to the bottom of the excavation. As soon as this grout is placed a series of precast panels are stacked one on top of the other, is lowered into the excavation and this chain of precast panels is horizontally aligned by a system of tongue and groove and the precast panel while its vertical alignment is insured by temporary continuous guide placed into the openings existing in the previously placed precast panels. This temporary continuous guide is lowered at the same rate as the precast panels to the bottom of the excavation thus interlocking the previously placed precast panels to the elements being placed. As noted above, squeezed into the tongue and groove recess is a bentonite sausage which insures the water tightness of this connection. As the stack of precast elements reaches the bottom, the suspending rods and the temporary continuous guide are withdrawn and a plastic tremie concrete is then simultaneously placed into the upstream an downstream concave spaces thus stabilizing and integrating the precast elements with the earth fill embankment and rock. The steps are sequentially repeated and a chain of precast stacked elements is formed.

It will be appreciated that the above is a purely illustrative of a preferred embodiment of the invention is not intended to be in any sense limiting. Many changes, modifications, adaptations can be incorporated into the invention without departing from the spirit and scope thereof.

What is claimed is:

1. In a slurry trench excavating method wherein a trench excavation having walls with surfaces is maintained full of a slurry for sustaining said walls of the excavation and an initial bore hole is made at the beginning of a line defining said excavation, said initial bore hole having a bottom, the improvement comprising, excavating adjacent unexcavated columns of earth along said line of said excavation from the bottom of said bore hole upwardly by a cutting tool having a cutting edge and reaction forces and a point of advancement such that cuttings fall away from said point of advancement of said cutting edge to improve the excavation rate, removing said cuttings from said slurry trench, and while said excavating progresses discharging the reaction forces from said cutting tool to a wall surface directly opposite and aligned with the surface of an adjacent unexcavated column.

2. The slurry trench excavating method defined in claim 1 wherein said excavating tool is a laterally movable rotary rock mill mounted on a frame, and including the steps of lowering said frame to the bottom of said initial bore hole and laterally extending said rotary rock mill to excavate in a lower end of said adjacent unexcavated column and then raising said frame and with said rotary rock mill being laterally extended, and repeating said steps of lowering, laterally extending and raising at least one additional time, the reaction forces from said rock mill being transmitted to said frame and thence to said wall surface.

3. The slurry trench excavating method defined in claim 2 including the step of continuing said excavating to form a slurry trench section having a length equal to the length of an initial panel section plus the height of said frame and excavating tool, installing a concrete panel element in said initial panel section, said concrete panel element having a guide channel formed in the end thereof facing in the direction of further excavation of said trench, said frame having a correspondingly shaped guide member adapted to fit therein and the surface having said guide channel constituting the wall surface receiving said reaction forces.

4. Excavating apparatus for making an excavation in rock in substantially vertical columns, said vertical columns having lower ends, comprising in combination, a frame having upper and lower ends and a substantially vertical bearing surface for bearing against a vertical surface opposite a substantially vertical reaction surface in said excavation, means on said frame for coupling to a source of vertical lift force, a rotary rock cutting mill and means for rotating said mill, a link member and pivot means pivotally mounting said link member proximate the lower end of said frame, means mounting said rotating rock cutting mill on said link member, motor means for pivoting said link member on said pivot means from a stowed position at the lower end of said frame outwardly toward the lower end of a vertical column of rock to be excavated to form cuttings by said rotary rock cutting mill, and fluid lift means for removing cuttings from said excavation.

5. Excavating apparatus as defined in claim 4 wherein said motor means rotates said rotary rock mill in direction such that the cuttings fall directly to the bottom of the excavation, and said fluid lift means removes cuttings from the bottom of said excavation.

6. Excavating apparatus as defined in claim 4 wherein said motor means and said means for rotating include hydraulic motors.

7. Excavating apparatus as defined in claim 4 including frame stabilizing means extending from said frame to engage a column of earth material above said rotary rock cutting mill.

8. A method of excavating a trench along a selected line in rocky terrain, forming an initial bore hole having a bottom, providing a rotary rock milling tool on a frame such that said rotary rock milling tool is laterally extendable relative to said frame, lowering said rotary rock milling tool and said frame to the bottom of said initial bore hole, laterally extending said rotary rock milling tool in a direction to extend said trench along said selected line and simultaneously discharging the reaction forces against a wall surface opposite the direction of said rotary rock milling tool is extended to form a trench bottom, gradually raising said frame and rotary rock milling tool to excavate an adjacent column of earth from the bottom upwards and allowing the cuttings to fall clear to the bottom of said trench without impeding the excavation, and removing the cuttings from the bottom of said trench.

* * * * *